United States Patent [19]

Matsuda

[11] Patent Number: 4,940,442

[45] Date of Patent: Jul. 10, 1990

[54] CONNECTABLE SELF-POWDERED MOBILE TOY

[75] Inventor: Takashi Matsuda, Tokyo, Japan

[73] Assignee: Takara Co., Ltd., Tokyo, Japan

[21] Appl. No.: 202,694

[22] Filed: Jun. 3, 1988

[30] Foreign Application Priority Data

Jun. 23, 1987 [JP] Japan ..... 62-96150[U]

[51] Int. Cl.[5] ..... A63H 17/00; A63H 33/04

[52] U.S. Cl. ..... 446/90; 446/95; 446/457; 446/465; 446/471; 213/75 TC

[58] Field of Search ..... 446/93–96, 446/90, 465, 470, 471, 431, 120, 121, 104, 102, 125, 457; 213/75 TC

[56] References Cited

U.S. PATENT DOCUMENTS

| | | | |
|---|---|---|---|
| 2,596,957 | 5/1952 | Olson et al. | 446/95 |
| 3,713,247 | 1/1973 | Parrilla | 446/95 X |
| 3,721,042 | 3/1973 | Marason, Jr. | 446/471 |
| 4,652,248 | 3/1987 | Kozuka | 446/444 |

FOREIGN PATENT DOCUMENTS

| | | | |
|---|---|---|---|
| 576917 | 5/1933 | Fed. Rep. of Germany | 446/97 |
| 2575935 | 7/1986 | France | 446/95 |

*Primary Examiner*—Mickey Yu

*Attorney, Agent, or Firm*—Price, Gess & Ubell

[57] ABSTRACT

A connectable mobile toy wherein a plurality of such toys can be interconnected front to back and side by side. The front-to-back connection allows swiveling so that a string of interconnected toys can negotiate turns and surface irregularities. Propulsion is provided by a spring-driven motor installed in one or more toys in the formation.

15 Claims, 2 Drawing Sheets

CONNECTABLE SELF-POWDERED MOBILE TOY

BACKGROUND OF THE INVENTION

1. Field of the Invention

The present invention relates generally to connectable self-powered mobile toys, and more particularly pertains to a connecting system of a mobile toy whereby a plurality of such toys can be interconnected in various configurations.

2. Description of the Prior Art

Inexpensive self-powered mobile toys are well known, and interconnection of a plurality of such mobile toys can be most entertaining. A front-to-back interconnection of a series of such toys is most common whereby the toys travel in a train-like procession. Many different types of interconnection designs are available that allow the toys to pivot side to side. However, in order for such a procession to travel smoothly over small surface irregularities and through curves, it is necessary for the interconnection to swivel in two dimensions. The couplings, and more particularly, the male/female connector-type couplings provided by the prior art for very inexpensive applications, do not generally allow for such freedom of movement. These couplings often provide for relatively firm interconnection which does not provide for smooth operation over a running surface. Furthermore, it is often desirable to interconnect such mobile toys side to side, which the couplings of the prior art do not generally provide.

In inexpensive toy cars, the body is frequently removable from the frame, and may have a small spring motor for driving the vehicle. An example of such a vehicle motor is shown in U.S. Pat. No. 4,478,313.

The prior art is still seeking to provide inexpensive toy cars that can permit additional play features for children.

SUMMARY OF THE INVENTION

An object of the present invention is to provide an inexpensive connecting structure for connecting two or more mobile toys.

A further object of the invention is to provide a structure for connecting the mobile toys in both a front to back, as well as a side to side manner.

Another object of the invention is to provide front-to-back connections that can swivel in two dimensions.

A further object of the invention is that the toy vehicles can be interconnected side by side in a variety of staggered arrangements.

Another object of the invention is to provide a connecting bar with which the toys can be interconnected.

Another object of the invention is to be able to snap together a formation of these toys that can be driven by one or more of the toys which are motorized.

According to the present invention, the foregoing and other objects are attained by a toy vehicle having a frame member with a plurality of male projections and female receptacles positioned around its periphery. A plurality of such toys can thereby be interconnected via any two complementary male/female connectors in both an in-line fashion, as well as a side-by-side configuration. The front-to-back connectors cooperate to swivel such that the mobile toys can negotiate turns and surface irregularities. Additional connector bars can be used to interconnect the toys. Propulsion of a plurality of interconnected toys can be provided, for example, by battery motors or by spring-drive mechanisms installed in the toys. Formations with various combinations of motorized and nonmotorized toys can provide entertaining stunt driving and racing displays.

BRIEF DESCRIPTION OF THE DRAWINGS

Other objects and many of the attendant advantages of this invention will be readily appreciated as the same becomes better understood by reference to the following detailed description when considered in conjunction with the accompanying drawings, in which like reference numerals designate like parts throughout the figures thereof and wherein.

DESCRIPTION OF THE PREFERRED EMBODIMENTS

The following description is provided to enable any person skilled in the mechanical toy field to make and use the present invention and sets forth the best modes contemplated by the inventor of carrying out his invention. Various modifications, however, will remain readily apparent to those skilled in the art, since the generic principles of the present invention have been defined herein specifically to provide a connectable mobile toy.

Figure 1:
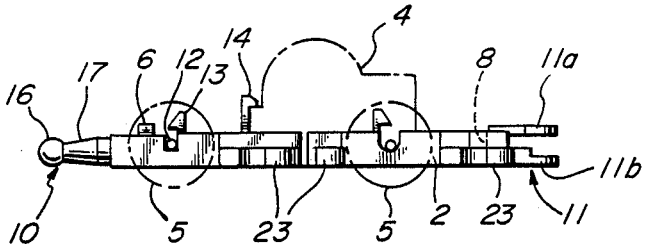
FIG. 1 is a side view of the present invention.
Figure 2:
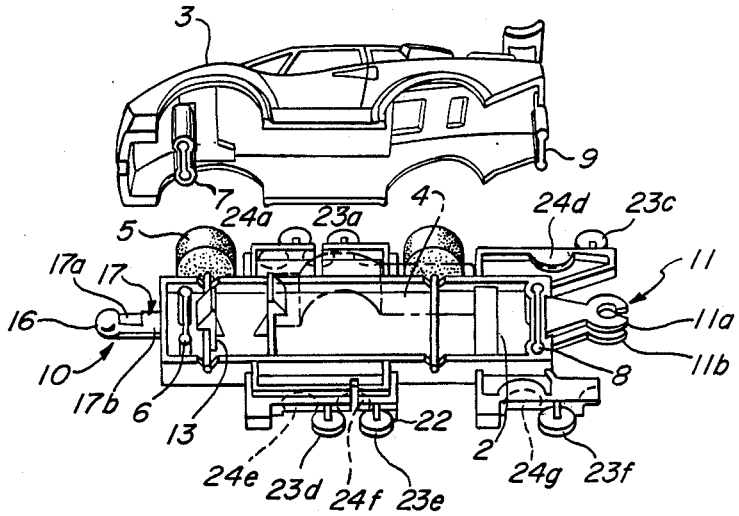
FIG. 2 is a perspective exploded view of an embodiment of the present invention.

FIG. 1 is a side view of a frame chassis 2 of a connectable mobile toy 1. FIG. 2 further discloses the relationship of the vehicle body 3 to the chassis 2. The body 3 is removably connected to the chassis 2 via a tab and slot arrangement wherein tab 9 and slot 7 on the body are fitted into the complementary tab 6 and slot 8 on the chassis 2. The chassis is provided with two pairs of wheels 5. Each pair of wheels is interconnected by an axle 12. Nondriven axles are held in place by the axle retainer 13, while the driven axle is supported by the motor housing 4, which is held in place by motor housing retainer 14. The motor comprises a spring drive mechanism as described in U.S. Pat. No. 4,478,313. The spring is wound by turning the drive wheels in reverse, and provides propulsion upon release of the toy. The toys can be fitted either with or without the drive mechanism. In a nondriven mobile toy, a second axle retainer 13 is fitted on the chassis to retain the rear axle and wheels in place of the motor housing.

FIG. 2 illustrates the positioning of various connectors arranged around the periphery of the chassis 2. The front connector 10 on a first toy is designed to interconnect with a complementary rear connector 11 of a second toy. The male front connector 10 comprises a ball member 16 mounted on a tapered neck 17, the diameter of which at 17*a* is less than at 17*b*. The female receptacle 11 comprises two annular ring members 11*a* and 11*b* arranged in parallel one above the other. Each ring member has a split portion at the distal end to provide flexibility. The dimension of the annular members 11*a* and 11*b* and the spacing between them defines a receptacle cavity which can accommodate the ball member 16. The natural resiliency of the plastic materials used to construct the coupling allows sufficient flexure of the annular members to enable insertion of the ball 16. Once in position, the resiliency of the material retains the ball 16. This configuration allows the neck 17 to which the ball 16 is attached to pivot right to left. The split in the ring allows an additional up and down freedom of movement. The split is sufficiently wide so as to allow up and down movement even when the front connector 10 is pivoted to the right or to the left to provide a swivel joint.

Figure 9:
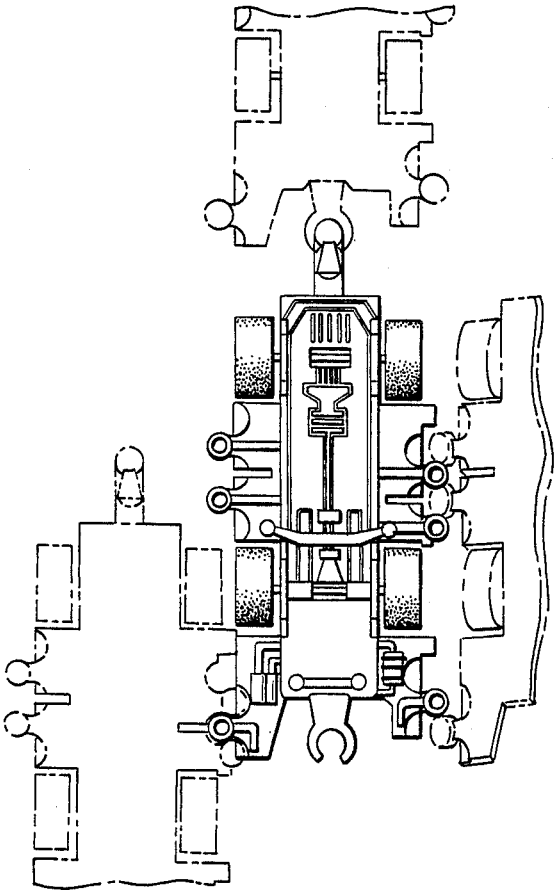
FIG. 9 is a schematic bottom plan view of the interconnection of frames.

As shown in FIG. 9, the connectors located on the sides of the chassis 3 of the mobile toy allow additional side-to-side interconnection. Each male projection comprises a disc-like structure 22 horizontally disposed in a nonsymmetrical relationship to the frame or chassis 2 in six offset locations around its periphery. The projections 23*a* and 23*b*, and similarly 23*d* and 23*e*, are spaced to precisely accommodate a similar male projection from a second mobile toy. Slit 27, located in between 23*a* and 23*b* as well as 23*d* and 23*e*, serves to impart a degree of resiliency to the two adjacent male projections so that another male projection can easily be introduced into the female receptacles 24 therebetween. The layout of the connector permits a number of arrangements of two adjacent toys. For example, projection 23*f* of a second toy can be inserted into space 24*b*. Similarly, projection 23*d* of the second toy can be inserted into space 24*a* for an aligned side-by-side arrangement, or for another staggered arrangement, projection 23*c* can be inserted into a second toy at 24*f*. The same combinations are available on the other side of the toy, thereby allowing a total of six different side-to-side interconnections.

Figure 3:
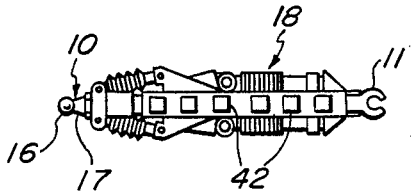
FIG. 3 is a top view of a connecting bar of the present invention.
Figure 4:
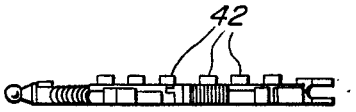
FIG. 4 is a side view of the connecting bar of the present invention.

FIGS. 3 and 4 illustrate a connector bar 18 which allows spaced interconnection of two mobile toys front to back. The connector bar has a male connector 10 with a ball 16 and tapered neck 17 on one side and the female receptacle 11 on the opposite side. Each connector is identical to that found on the chassis itself. A series of studs 42 is disposed on the top of the length of the connector bar.

Figure 5:
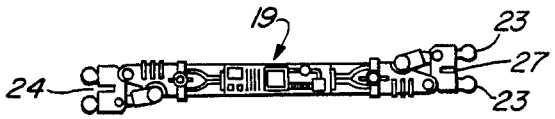
FIG. 5 is a top view of another connecting bar of the present invention.
Figure 6:
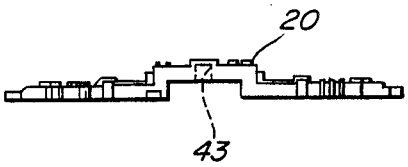
FIG. 6 is a side view of the embodiment of FIG. 5.

FIGS. 5 and 6 illustrate a connector bar 19 for interconnecting cars side to side. Each side of the bar has two male projections 23 on either side of a receptacle 24. The resiliency of the connector bar to allow accommodation of a male connector in between the two male connectors is again accomplished via the slit 27. The center of the bar has a raised segment 20, the center of which has a slot 43 capable of accommodating stud 42 of the front-to-back connector bar. A plurality of toys can consequently be interconnected in a great variety of different combinations using the connectors affixed to the toys' chassis.

Figure 7:
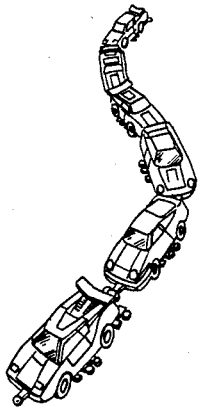
FIG. 7 is a perspective view of a plurality of toys interconnected according to the present invention.

FIG. 7 illustrates a series of such mobile toys interconnected via the male/female joints 10, 11 of their frames. A continuous train of such mobile toys can be assembled in the manner illustrated in FIG. 7.

Figure 8:
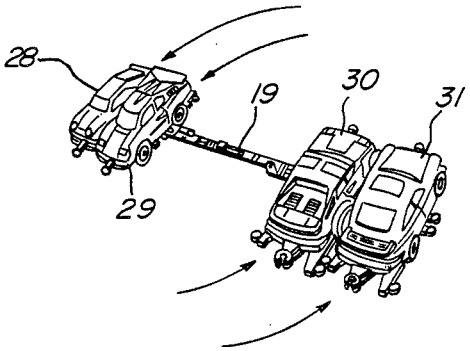
FIG. 8 is a perspective view of a plurality of toys interconnected according to the present invention.

FIG. 8 illustrates the use of connector bar 19 to interconnect mobile toys 29, 30. In addition, mobile toys 28, 31 are interconnected to the adjacent mobile toys via the respective side connectors 23, 24.

Figure 10:
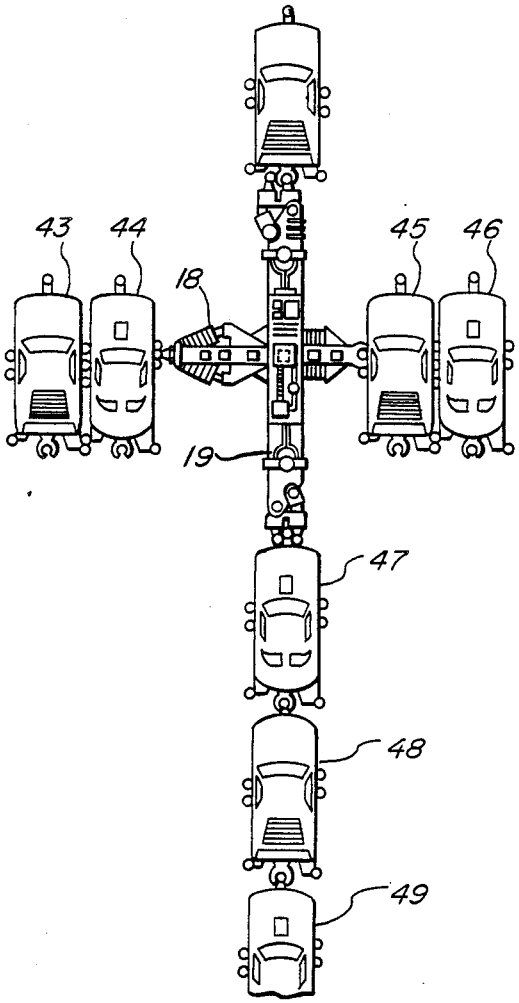
FIG. 10 is a schematic of a vehicle formation with a pair of cross bars.

FIG. 10 illustrates a crossed arrangement using both connector bars 18, 19. The six studs 42 located on top of connector bar 18 allow the connector bar 19 to be arranged in six different positions to interconnect mobile toys 43 to 50.

Combining motorized mobile toys and nonmotorized toys provides for entertaining displays. For example, selective placement of motorized toys with nonmotorized toys provides for either a relatively straight-line movement, or can cause the entire formation to turn and spin. Similar symmetric and asymmetric arrangements can be accommodated in the formation of FIG. 8. A motorized unit on either side of the connector bar 19 in FIG. 6 will cause the formation to turn in a tight circle. The tab 6, 9 and slot 7, 8 arrangement allows ready interchangeability of various body styles with motorized and nonmotorized chassis.

Obviously, many modifications and variations of the present invention are possible in light of the above teachings. It is therefore to be understood that, within the scope of the appended claims, the invention may be practiced otherwise than as specifically described.

What is claimed is:

1. In an improved connectable mobile toy vehicle, the improvement comprising:

a body member, and a plurality of connecting means arranged around the periphery of the body member, including a plurality of male projections and a plurality of female receptacles capable of receiving the male projections, one of the male projections comprising a ball mounted to the toy vehicle on a horizontally-disposed slender neck, and one of the female receptacles comprising a pair of split annular members mounted to the toy horizontally, one over the other, with the splits located on distal ends of the annular members such that the ball of the male projection can be snapped into position in between the annular female members whereby a plurality of such toy vehicles can be interconnected in various combinations including both front-to-back, as well as side-to-side arrangements, other male projections on a side of the toy vehicle include spaced horizontally-disposed disc members, the spaces between the disc members being capable of receiving the disc members from a second toy vehicle and also functioning as female receptacles.

2. The improved toy of claim 1 wherein a male projection is mounted on a front of the toy vehicle and a female receptacle is mounted on a rear of the toy vehicle, the respective male projection and female receptacle present a swivel joint interconnection with a mobile toy vehicle of a similar configuration.

3. The improved connectable mobile toy vehicle of claim 1 further comprising a first connector bar capable of interconnecting two of the toy vehicles front to back in a spaced relation.

4. The improved connectable mobile toy vehicle of claim 3 further comprising a second connector bar capable of interconnecting the toys side-to-side in a spaced relation and capable of attaching to the first connector bar.

5. In an improved connectable mobile toy vehicle, the improvement comprising:

a body member, and a plurality of connecting means arranged around the periphery of the body member, including male projections of a curvilinear configuration and female receptacles of a horizontally disposed disc configuration of a size capable of interconnecting with the male projection, each male projection having a female receptacle immediately adjacent at least one side of the male projection.

6. The improved connectable mobile toy vehicle of claim 5 further comprising a first connector bar capable of interconnecting two such toy vehicles, front to back in a spaced relation.

7. The improved connectable mobile toy vehicle of claim 6 further comprising a second connector bar capable of interconnecting the toy vehicles side-to-side in a spaced relation and capable of attaching to the first connector bar.

8. In an improved toy vehicle with means for locomotion, the improvement comprising:

a frame member having a plurality of male projections extending outward on two sides of the frame with complementary female receptacles positioned on at least one side of each male projection to permit a removable interconnection with another frame member of similar configuration, further including a male ball connection member and a female receptacle including a pair of split annular members positioned on the frame member.

9. The invention of claim 8 further including a vehicle body wherein the frame member supports the vehicle body and extends beyond the vehicle body, and a male projection is positioned on the extended frame on either side of the frame member.

10. The invention of claim 9 wherein the male projections are nonsymmetrically positioned relative to each side of the frame member.

11. The invention of claim 8 further including a vehicle body wherein the frame member includes a pair of posts integrally interconnected by a rectangular wall at one end of the frame member and an aperture having substantially circular openings interconnected by a rectangular opening at the other end of the frame member for removably connecting the vehicle body.

12. The toy vehicle set of claim 8 further including a first connector bar capable of interconnecting two of such toy vehicles front to back in a spaced relation.

13. The toy vehicle set of claim 12 further including a second connector bar capable of interconnecting the toy vehicles side-to-side in a spaced relation and capable of attaching to the first connector bar.

14. In a toy vehicle set of at least a pair of toy vehicles, one toy vehicle has means for propelling it, including two pairs of wheels and a motor, the other vehicle has two pairs of wheels but no propulsion capability, and both vehicles have a simulated vehicle body, the improvement comprising:

a frame member for each toy vehicle connected to the vehicle body, each frame member having a plurality of male projections extending outward from the frame member and beyond the body member on both sides of the frame with complementary female receptacles positioned on either side of at least one male projection on each side of the frame member.

15. The invention of claim 14 wherein the male projections are nonsymmetrically positioned relative to each side of the frame member.

* * * * *